United States Patent [19]

Trout

[11] 4,403,655

[45] Sep. 13, 1983

[54] DRAW WORKS DISABLING DEVICE FOR USE WITH A WELL DRILLING APPARATUS

[76] Inventor: Buster B. Trout, 1220 Idaho, Chickasha, Okla. 73018

[21] Appl. No.: 236,318

[22] Filed: Feb. 20, 1981

[51] Int. Cl.[3] ..... E21B 7/00

[52] U.S. Cl. ..... 166/75 R; 175/27; 175/38; 173/3; 173/4; 254/273

[58] Field of Search ..... 175/27, 38; 166/363, 166/364, 75; 254/273, 275; 173/3, 4, 9

[56] References Cited

U.S. PATENT DOCUMENTS

| | | | |
|---|---|---|---|
| 1,891,329 | 12/1932 | Le Compte | 173/3 |
| 3,044,481 | 7/1962 | Regan | 251/1 R |
| 3,104,864 | 9/1965 | Melton et al. | 254/273 |
| 3,552,502 | 1/1971 | Wilson | 175/38 |
| 3,677,352 | 7/1972 | Lloyd | 175/27 |
| 3,746,102 | 7/1973 | Griffin | 175/27 |
| 4,144,953 | 3/1979 | Johnson | 175/27 |
| 4,337,653 | 7/1982 | Chauffe | 166/53 |

*Primary Examiner*—William F. Pate, III

*Attorney, Agent, or Firm*—Christopher H. Morgan

[57] ABSTRACT

A device for disabling the draw works of a well drilling apparatus responsive to the locking of the drill string by a blow out prevention device. The device comprises an air-actuated valve connected for regulating the flow of air to the air-actuated clutch of the draw works. A second valve regulates the flow of pressurized air to the air actuated valve. The second valve is responsive to the actuation of the blow out prevention device by an accumulator valve.

13 Claims, 2 Drawing Figures

55
57
65
61
63
61

55
53
57
51
63
43
61
41
59
45
39
51
37
33

11
29
13
19
21
17
25
35
27
25
23
13
49
49
47
31
15

DRAW WORKS DISABLING DEVICE FOR USE WITH A WELL DRILLING APPARATUS

BACKGROUND OF THE INVENTION

1. Field of the Invention

This invention relates in general to well drilling apparatus and more particularly to devices for regulating the movement of a drill string or pipe utilized in well drilling.

2. Description of the Prior Art

In the past, most oil drilling apparatus have utilized a draw works consisting of a powered rotating drum for raising and lowering the drill string by means of a drilling cable. The drilling cable is carried on the powered rotating drum of the draw works and is received through sheaves located in the crown and traveling block. The traveling block is connected to a drill string pipe such that rotation of the draw works drum raises and lowers the drill string pipe.

In most well drilling apparatus the draw works is operated by means of a clutch which is connected to and actuated by pressurized air from an air supply. An air valve regulates the supply of air from the air supply to the draw works clutch to engage the draw works. The air valve is generally located on a driller's console so that a driller operator can manually engage the draw works by means of this valve.

Most well drilling apparatus also include a blowout prevention device which locks or freezes the drill string pipe in position. This prevents the pipe from being lifted out of the well due to pressure changes within the well. The blow out prevention device also usually cuts off the supply of mud which is circulated into the well during the drilling process. The blow out preventer includes hydraulically actuated rams which engage the drill string pipe when hydraulic pressure is supplied to the blow out preventer. Hydraulic pressure is supplied to the blow out preventer from a source of hydraulic fluid generally known as an accumulator. The accumulator also supplies hydraulic fluid for various hydraulically operated devices around the drilling apparatus. A particular valve on the accumulator supplies hydraulic pressure to the blow out preventer and engages the rams with the drill string pipe, locking the pipe against movement.

In the past, a particular problem with well drilling apparatus has been that the blow out prevention device has often been engaged when the draw works has been inadvertently or absent-mindedly operated. When this happens, the drill string pipe will be damaged and often the pipe is severed. Usually various other equipment is destroyed in the effort to move the locked drill pipe. If severed, the pipe often falls into the hole and is lost either before or after the blow out preventer is disengaged.

In most well drilling apparatus the accumulator and its valves, and the driller's console and the draw works valve are not located in the same position. This prevents immediate mechanical connection between the blow out prevention accumulator valve and the draw works control valve. Moreover, a mechanical connection would interfere with the regular operation of the draw works.

SUMMARY OF THE INVENTION

It is an object of the present invention to provide an improved well drilling apparatus and particularly an improved well drilling apparatus with a device for disabling the draw works when the blow out preventer is engaged. By this means, damage to the drill string and to other equipment can be prevented.

It is also an object of the present invention to provide such a device for disabling the draw works which device can be easily attached to presently existing well drilling apparatus and which is effective in disabling the draw works but does not interfere with the general operation of the draw works.

It is still further an object of the present invention to provide a disabling device for disabling the draw works of a well drilling apparatus which is safe and which utilizes standard pieces of equipment and does not require extensive alterations of the presently existing equipment.

In accordance with these objects the present invention is utilized with well drilling apparatus of the type which includes a draw works for raising and lowering a drill string, a manual operation device connected to the draw works for manually operating the draw works, and an accumulator connected through an accumulator valve for supplying hydraulic fluid to a blow out prevention means which locks the drill string against movement. The device comprises a means for disabling the manual operation device which actuates the draw works. It also includes an activating means for activating the disabling means and this activating means is responsive to the actuation of the accumulator locking the drill string against movement. Thus, the present invention disables the manual operation of the draw works upon the locking of the drill string by the blow out prevention means.

In most cases, the draw works is operated by a manually operated valve which regulates the supply of air from an air supply to an air actuated clutch on the draw works. Preferably, the present invention includes a pressure actuated valve disposed on the air supply conduit between the air supply and the draw works. A second air supply conduit is connected from the air supply to the pressure actuated valve. A second valve is connected to regulate the supply of air to the pressure actuated valve. This second valve is responsive to operation of the accumulator valve which engages the blow out prevention device.

For a further understanding of the invention and further objects, features and advantages thereof, reference may now be had to the following description taken in conjunction with the accompanying drawings.

DESCRIPTION OF PREFERRED EMBODIMENTS

Figures 1, 2:
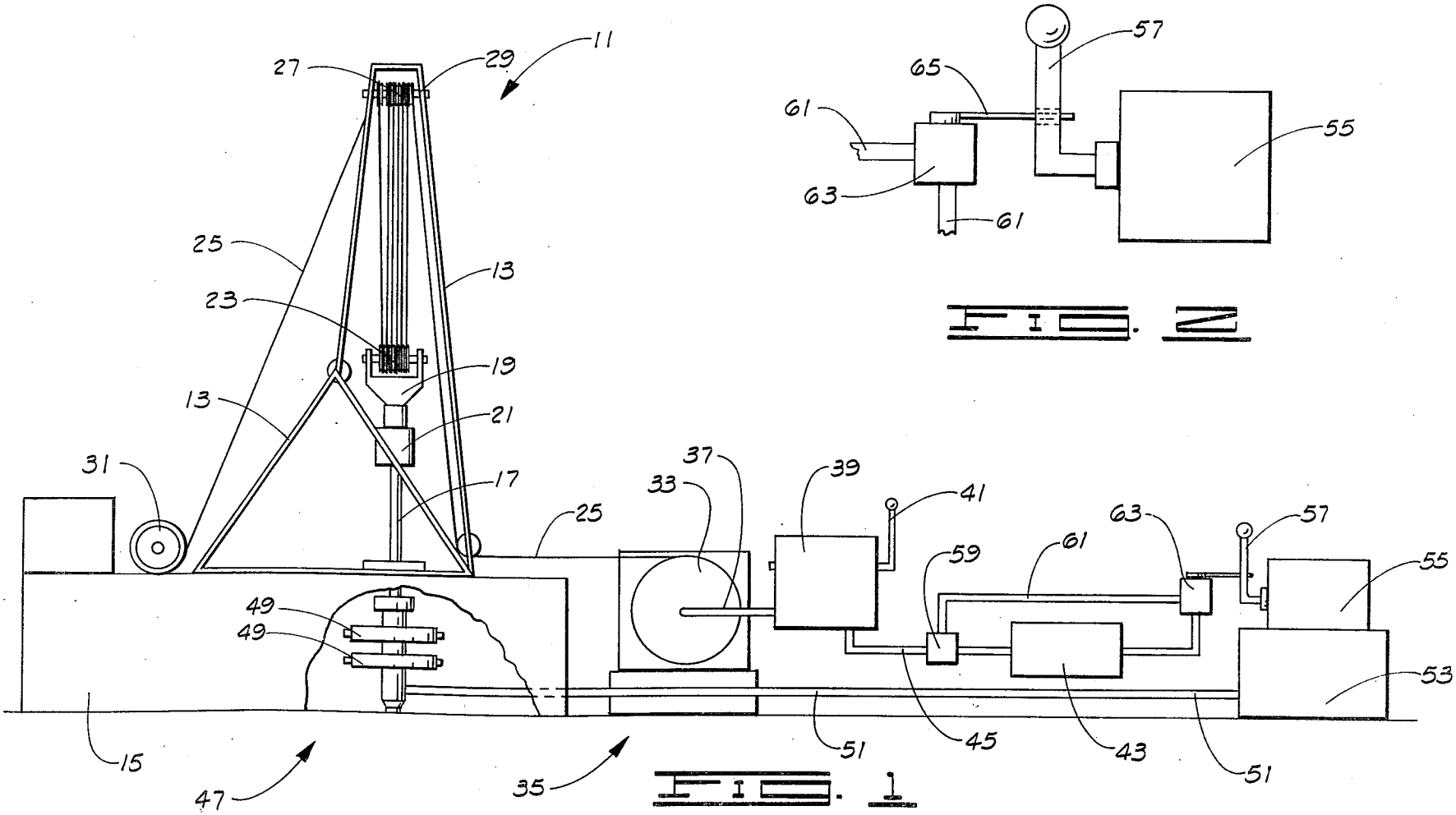
FIG. 1 is a schematic representation of a well drilling apparatus including the present invention.
FIG. 2 is an enlarged schematic representation of a portion of the device shown in FIG. 1.

Referring now to FIG. 1, a well drilling apparatus is schematically shown generally at 11. The apparatus 11 includes a derrick structure 13 which rests on a drilling platform 15. One purpose of the derrick structure 13 is to provide a support for raising and lowering a drill string pipe 17. The drill string pipe 17 is, of course, utilized in drilling the well and extends into the well.

The upper end of the drill string pipe 17 has a collar which is attached to a traveling block 19 by a clamp 21.

A series of sheaves 23 are journaled to the traveling block 19. A drilling cable 25 is wound through the sheaves 23 and also through a series of sheaves 27 journaled to a crown 29 at the top of derrick structure 13. One end of the drilling cable 25 is wound about a cable storage spool 31. The other end of cable 25 is wound about a draw works drum 33. The draw works drum 33 is powered for rotation and by rotation raises and lowers the drill string pipe 17. The sheaves 27 and 23 form a pulley to translate the winding of the drilling cable 25 on draw works drum 33 into motion for raising and lowering the drill string pipe 17.

The draw works drum 33 is only one element of the draw works 35. Of course, an engine is provided for powering the drum rotation. A transmission and clutch are connected between the engine and the draw works drum 33 to regulate the rotation and the direction of rotation of the draw works drum 33. The clutch is actuated by air pressure supplied through one or more air supply conduits 37. The conduit 37 is attached to a draw works valve 39 which regulates the supply of air through conduits 37. A valve handle 41 manually regulates the supply of air to conduits 37, and, therefore, regulates the rotation and direction of rotation of draw works drum 33.

Air is supplied from an air supply source 43 to draw works valve 39 through a conduit 45. The air supply source 43 generally consists of an air compressor and a storage tank.

Usually, the draw works valve 39 is mounted on a driller's console located on the drilling platform 15. By adjusting the position of handle 41 the driller regulates the operation of the draw works and the raising and lowering of traveling block 19 and the drill string pipe 17 attached thereto.

Still referring to FIG. 1, a blow out prevention device is shown generally at 47. The blow out prevention device 47 includes a pair of hydraulic rams or jaws 49 which can engage and lock the drill string pipe 17. Hydraulic fluid is supplied to the rams 49 through a conduit 51. The source of hydraulic fluid and pressure connected to the blow out preventer 47 through the hydraulic conduit 51 is an accumulator 53. The accumulator 53 includes a valve 55 which regulates the flow of hydraulic fluid through conduit 51. Valve 55 is actuated by an accumulator valve handle 57.

Each of the elements described above is convention and the details of each are well known to those skilled in the art. The schematic representation of FIG. 1 omits many of the details of these elements because these details do not specifically effect the combination and operation of the present invention.

To disable the draw works 35, the present invention utilizes a valve 59 connected to regulate the flow of air through conduit 45. When valve 59 is closed no air is supplied from the air supply source 43 to the draw works valve 39. When no air is supplied from the air supply source 43 to the draw works clutch through valve 39 the draw works 35 cannot be operated and cable 25 can not be moved.

Valve 59 is a pressure-closed valve; i.e., a valve which closes when pressurized fluid is supplied to the actuation mechanism of the valve. Such pressure-closed valves are common and the construction of these valves is well known in the art.

An air conduit 61 is connected to supply pressurized air from the air supply source 43 to the actuation mechanism of valve 59. One end of conduit 61 is connected to valve 59 and the other end is connected to the air supply source 43.

A valve 63 is connected to conduit 61 to regulate the flow of pressurized air from the air supply source 43 to valve 59. When the valve 63 is open pressurized air is supplied to valve 59 through conduit 61 and valve 59 closes. When valve 63 is closed, the portion of conduit 61 between valve 59 and 63 is vented and valve 59 opens.

Referring now to FIG. 2 as well as FIG. 1, valve 63 is actuated by a lever arm 65. This arm 65 is mechanically connected to the accumulator valve handle 57. The connection is such that the movement of handle 57 to supply hydraulic fluid from the accumulator 53 to the blow out prevention device 47 moves arm 65 to a position which opens valve 63 and supplies air from the air supply source 43 to valve 59. The movement of handle 57 to a position which releases the rams 49 closes valve 63 and relieves the air pressure to valve 59.

Arm 65 can be connected to handle 57 in a variety of ways. One method is to drill a hole in handle 57 through which arm 65 can extend and pivot. Other mechanical linkages will be apparent to those skilled in the art. Those skilled in the art will also recognize that valve 63 can readily be mounted to accumulator 53 in a manner which allows the combination to cooperate as described above.

To attach the device of the present invention the valve 63 is mounted on accumulator 53 so that arm 65 is mechanically connected to handle 57. Valve 59 is connected to conduit 45. An air supply conduit is then connected from air supply source 43 to valve 63 and from valve 63 to the actuation mechanisms of valve 59.

In operation, the present invention disables the draw works in response to the closing of the pipe rams 49 locking the drill string pipe 17. This prevents an inadvertent or absent-minded attempt to raise the drill string pipe 17 when the rams 49 are locked about pipe 17.

Each time handle 57 is moved to a position which supplies hydraulic fluid to blow out prevention device 47 and closes rams 49 about pipe 17, valve 63 is opened and pressurized air closes valve 59. The closing of valve 59, in turn, prevents air from being supplied from the air supply source 43 to the draw works clutch through draw works valve 39. Thus, opening valve 57 disables the draw works 35.

After the rams 49 have been locked about drill string pipe 17 the draw works can be activated only by disengaging the rams 49 by closing valve 55. The movement of handle 57 to close valve 55 closes valve 63 and vents the air in conduit 61 between valve 59 and valve 63. This opens valve 59 which, in turn, communicates the air supply source 43 with draw works valve 39. The draw works 35 can then be operated by the valve handle 41.

Thus, the draw works disabling device of the present invention is well adapted to obtain the objects and advantages mentioned as well as those inherent therein. While presently preferred embodiments of the present invention have been described for the purpose of this disclosure, numerous changes in the construction and arrangement of parts can be made by those skilled in the art which changes are encompassed within the spirit of this invention as defined by the appended claims.

The foregoing disclosure and the showings made in the drawings are merely illustrative of the principles of this invention and are not to be interpreted in a limiting sense.

What is claimed is:

1. A device for disabling the draw works of a well drilling apparatus of the type which includes a pressurized air supply connected through a draw works valve for actuating the draw works and an accumulator connected through an accumulator valve for supplying hydraulic fluid to a blow out prevention device which locks the drill string against movement, comprising:

a first valve for regulating the supply of air from said pressurized air supply to said draw works; and fluid conveyance means for actuating said first valve responsive to the actuation of said accumulator holding said drill string against movement for actuation of said first valve such that said pressurized air supply is isolated from said draw works and such that the movement of said draw works is prevented.

2. The device of claim 1 wherein said first valve comprises a valve responsive to air pressure and wherein said means for actuating said first valve comprises:

an air conveyance conduit connected at one end to said air pressure supply and at the other end to said first valve for actuating said first valve by air pressure; and a second valve connected to said air conveyance conduit for regulating the flow of air in said air conveyance conduit.

3. The device of claim 2 wherein said second valve is connected to and responsive to said accumulator valve.

4. The device of claim 3 wherein said second valve is mechanically actuated by an arm mechanically connected to said accumulator valve.

5. The device of claim 4 wherein said second valve is opened by movement of said accumulator valve to a position for locking said drill string and wherein said first valve is closed when pressurized air is conveyed to said first valve through said air conveyance conduit.

6. An improved well drilling apparatus of the type which includes a pressurized air supply connected through a draw works valve for actuating the draw works and an accumulator connected through an accumulator valve for supplying hydraulic fluid to a blow out prevention means for locking the drill string against movement, the improvement comprising:

a first valve connected for regulating the supply of air from said pressurized air supply to said draw works; and fluid conveyance means for actuating said first valve responsive to the actuation of said accumulator holding said drill string against movement for actuating said first valve, isolating said pressurized air supply from said draw works and preventing the movement of said draw works.

7. The device of claim 6 wherein said first valve comprises a valve responsive to air pressure and wherein said means for actuating said first valve means comprises:

an air conveyance conduit connected at one end to said air pressure supply and at the other end to said first valve for actuating said first valve by air pressure; and a second valve connected to said air conveyance conduit for regulating the flow of air in said air conveyance conduit.

8. The device of claim 7 wherein said second valve is connected to and responsive to the movement of said accumulator valve.

9. The device of claim 3 wherein said second valve is mechanically actuated by an arm mechanically connected to said accumulator valve.

10. The device of claim 9 wherein said second valve is opened by the movement of said accumulator valve to a position for locking said drill string and wherein said first valve is closed when pressurized air is conveyed to said first valve through said air conveyance conduit.

11. An improved oil well drilling apparatus of the type which includes a pressurizued air supply connected by a draw works air conduit to a draw works which raises and lowers a drill string, a draw works valve disposed on said draw works valve conduit for regulating the supply of pressurized air from said pressurized air supply to said draw works, and an accumulator connected to an accumulator valve for supplying hydraulic fluid to a blow out prevention means for locking the drill string against movement, the improvement comprising:

a first valve disposed on said draw works air conduit for regulating the flow of pressurized air from said pressurized air supply to said draw works, said first valve being actuated by air pressure;

an air conveyance conduit connected at one end to said pressurized air supply and at the other end to said first valve for actuating said first valve by air pressure; and a second valve connected to said air conveyance conduit for regulating the flow of air in said air conveyance conduit and connected to and responsive to said accumulator valve such that actuation of said accumulator valve to lock said drill string actuates said second valve which, in turn, actuates said first valve and prevents movement of said draw works.

12. The device of claim 11 wherein said second valve is mechanically actuated by a lever mechanically connected to said accumulator valve.

13. The device of claim 12 wherein said second valve is opened by the movement of said accumulator valve to a position for locking said drill string and wherein said first valve is closed when pressurized air is conveyed to said first valve through said air conveyance conduit.

* * * * *